US009982909B1

(12) United States Patent
Perez et al.

(10) Patent No.: US 9,982,909 B1
(45) Date of Patent: May 29, 2018

(54) AIR CONDITIONING MOUNTING BRACKET ASSEMBLY

(71) Applicants: Valentina Perez, Chicago, IL (US); Taina V. Perez, Chicago, IL (US)

(72) Inventors: Valentina Perez, Chicago, IL (US); Taina V. Perez, Chicago, IL (US)

( * ) Notice: Subject to any disclaimer, the term of this patent is extended or adjusted under 35 U.S.C. 154(b) by 0 days. days.

(21) Appl. No.: 15/406,294

(22) Filed: Jan. 13, 2017

(51) Int. Cl.

| | |
|---|---|
| ***F16M 1/00*** | (2006.01) |
| ***F24F 13/32*** | (2006.01) |
| ***F24F 1/02*** | (2011.01) |
| ***F16M 13/02*** | (2006.01) |

(52) U.S. Cl.
CPC ..... *F24F 13/32* (2013.01); *F16M 13/02* (2013.01); *F24F 1/027* (2013.01); *F24F 2221/20* (2013.01)

(58) Field of Classification Search
CPC ..... F24F 13/32; F24F 1/027; F24F 2221/20; F16M 13/02; A47L 3/02; E06B 7/03; E06B 7/28
USPC ..... 248/674, 208–209, 232, 236, 240, 242, 248/240.3–240.4; 182/53; 454/204; 62/262
See application file for complete search history.

(56) References Cited

U.S. PATENT DOCUMENTS

| | | | | |
|---|---|---|---|---|
| 2,436,713 A * | 2/1948 | Cody | F24F 13/32 182/58 |
| 5,967,478 A * | 10/1999 | Tynes | A47L 345/00 248/208 |
| 8,584,998 B1 * | 11/2013 | Peterson | F24F 13/32 182/62 |
| 2013/0153744 A1 * | 6/2013 | Jin | F24F 13/32 248/670 |

* cited by examiner

*Primary Examiner* — Christopher Garft
(74) *Attorney, Agent, or Firm* — RG Patent Consulting, LLC; Rachel Gilboy

(57) ABSTRACT

An air conditioning mounting bracket assembly is a fully adjustable bracket assembly designed to be installed on the exterior of a window or thru wall air conditioner, manufactured of heavy duty steel and plastic Plexi-material for strength and durability. Sheeting material will encompass the entire exterior of the A/C unit, with grating integrated into the support plates to allow free circulation of air. Screws and hook and loop material will be included for use in mounting the assembly to the exterior of the window frame, and heavy duty threaded bolts are included to mount the A/C unit to the mounting assembly. Telescoping components enable the user to lengthen or shorten the assembly in accordance to the dimensions of the window frame or wall niche.

11 Claims, 4 Drawing Sheets

AIR CONDITIONING MOUNTING BRACKET ASSEMBLY

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of air conditioning unit mount brackets and more specifically relates to a specially designed support brace configured expressly for use with window or thru-wall air conditioning units to provide consumers who have these units installed in their homes or businesses an effective and reliable means of stabilizing and securing these devices during use. As such, the Air-Con Stabilizer would effectively prevent the air conditioner from accidentally falling from the window, damaging the unit and in worse case scenarios causing injury to pedestrians on the ground below.

2. Description of the Related Art

Millions of consumers live in dwellings such as homes, apartments, and condominiums where window or thru-wall air conditioners are utilized to cool the home during the hot summer months. An affordable alternative to installing a central air conditioning system, window and thru-wall air conditioners are installed within an open window or an open-ended niche that is cut into the surface of a wall, with the front of the air conditioner protruding inside the home and the back end of the unit protruding outside. Window air conditioning units are configured to be held in place via a tension fit, with the window framework or surrounding walls serving to support the air conditioner and hold it in place.

Not surprisingly, because of the excessive weight of these appliances, actually securing an air conditioner within a window frame or wall niche can be extremely challenging and if not securely stabilized, accidents can occur. Specifically, if an air conditioner is not properly secured within a window or wall niche, the air conditioner can actually fall out of the framework in which it is installed, often resulting in irrevocable damage to the appliance. More importantly, if pedestrians or animals are on the street below the falling air conditioner, the result can be that they sustain serious injury or in a worse-case scenario, death.

Various attempts have been made to solve the above-mentioned problems such as those found in U.S. Pat. No. 2,935,284 to Reeves Wayne W.; U.S. Pat. No. 2,717,139 to Jewell Bernard W.; and U.S. Pat. No. 7,350,759 to Robert R. Gray. This art is representative of air conditioning unit mount brackets. None of the above inventions and patents, taken either singly or in combination, is seen to describe the invention as claimed.

Ideally, an air conditioning mount bracket should provide relative ease of installation, would stabilize and secure an A/C unit, and yet would operate reliably and be manufactured at a modest expense. Thus, a need exists for a reliable air conditioning mounting bracket assembly to avoid the above-mentioned problems.

BRIEF SUMMARY OF THE INVENTION

In view of the foregoing disadvantages inherent in the known air conditioning mount bracket art, the present invention provides a novel air conditioning mounting bracket assembly. The general purpose of the present invention, which will be described subsequently in greater detail is to provide a support brace configured expressly for use with window or thru-wall air conditioning units which stabilizes and secures these devices during use.

An air conditioning mounting bracket assembly for use with a portable air conditioning unit is disclosed herein comprising a main bracket member including a base portion, two side portions with vent openings attached to opposite ends of the base portion and extending upwards, an attachment member connected to one of the two side portions which is adapted to connect with a side of the portable air conditioning unit, to securely connect the air conditioning mounting bracket assembly to a portable air conditioning unit. It further has an upper bracket formed as two brackets and telescopingly connected together having side panels extending downwardly from a main portion, having elongated apertures on the side panels adapted to attach to the main bracket member. The upper bracket is vertically adjustable and adapted to provide support for the main bracket member while a portable air conditioning unit is mounted therein.

It further has an elongated attachment bracket connection member attached to a bottom surface of the base portion, and includes releasable connectors on opposite ends formed as screw members. A support bracket member including an elongated panel portion extends downward from the main bracket member base portion, and has releasable connector receivers on opposite ends which receive the releasable connectors of the attachment bracket connection member, such that the support bracket member is securely attachable to the main bracket member.

The support bracket member extends substantially along the length of the main bracket member base portion and is formed as two support bracket panels telescopically connected to each other, and is able to be adjusted with respect to the size of a wall or window opening. The support bracket member is adapted to contact a wall or window that the portable air conditioning unit is to be installed within to provide support to the portable air conditioning unit. The connector receivers of the elongated panel portion are formed having threaded apertures adapted to connect with the screw members of the attachment bracket connection member.

The attachment member of the main bracket member is formed having a threaded post and a handle member which threadably connects to one of the two side portions having a threaded aperture. The opposite side portion of the main bracket member has hook and loop fastener attached to an inner surface and is adapted to connect with hook and loop fastener which is connected to the side wall of a portable air conditioning unit to aid in attaching the portable air conditioning unit to the air conditioning mounting bracket assembly. The air conditioning mounting bracket assembly is formed from a material chosen from a group of materials consisting of stainless steel, aluminum, plastic, and ceramic.

The present invention holds significant improvements and serves as an air conditioning mounting bracket assembly. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, air conditioning mounting bracket assembly constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to an air conditioning mount bracket and more particularly to an air conditioning mounting bracket assembly as used to improve the ability of a user to securely mount a window or thru-wall air conditioning unit during use, and prevent it from falling out of the window and damaging the unit, or worse, falling on an unsuspecting person below, causing serious injury or death.

Generally speaking, the air conditioning mounting bracket assembly is a fully adjustable bracket assembly designed to be installed on the exterior of a window or thru wall air conditioner, manufactured of heavy duty steel and plastic Plexi-material for strength and durability. Sheeting material will encompass the entire exterior of the A/C unit, with grating integrated into the support plates to allow free circulation of air. Screws and hook and loop material will be included for use in mounting the assembly to the exterior of the window frame, and heavy duty threaded bolts are included to mount the A/C unit to the mounting assembly. Telescoping components enable the user to lengthen or shorten the assembly in accordance to the dimensions of the window frame or wall niche.

Figure 1:
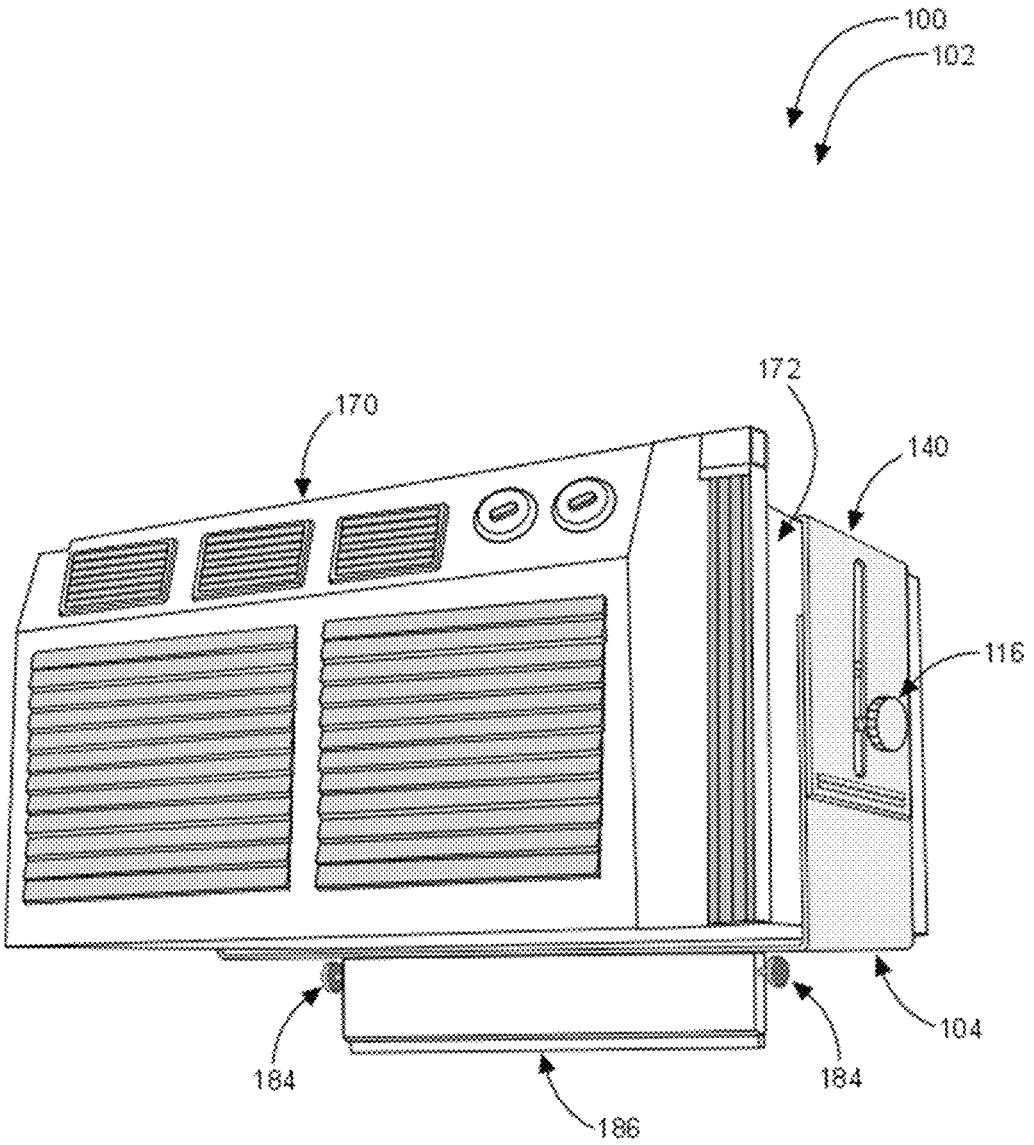
FIG. 1 shows a perspective view illustrating an air conditioning mounting bracket assembly in an in-use condition according to an embodiment of the present invention.

Referring to the drawings by numerals of reference there is shown in FIG. 1, a perspective view illustrating an air conditioning mounting bracket assembly 100 in an in-use condition 102 according to an embodiment of the present invention.

Air conditioning mounting bracket assembly 100 for use with portable air conditioning unit 170 is disclosed herein comprising main bracket member 104 including base portion 108, two side portions 110 with vent openings 112 attached to opposite ends of base portion 108 and extending upwards, attachment member 116 connected to one of the two side portions 110 which is adapted to connect with a side wall 172 of portable air conditioning unit 170, to securely connect air conditioning mounting bracket assembly 100 to portable air conditioning unit 170. It further has upper bracket 140 formed as two brackets 144 and telescopingly connected together having side panels 146 extending downwardly from main portion 150, having elongated apertures 154 on side panels 146 adapted to attach to main bracket member 104. Upper bracket 140 is vertically adjustable 158 and horizontally adjustable 160 and adapted to provide support for main bracket member 104 while portable air conditioning unit 170 is mounted therein.

Figure 2:
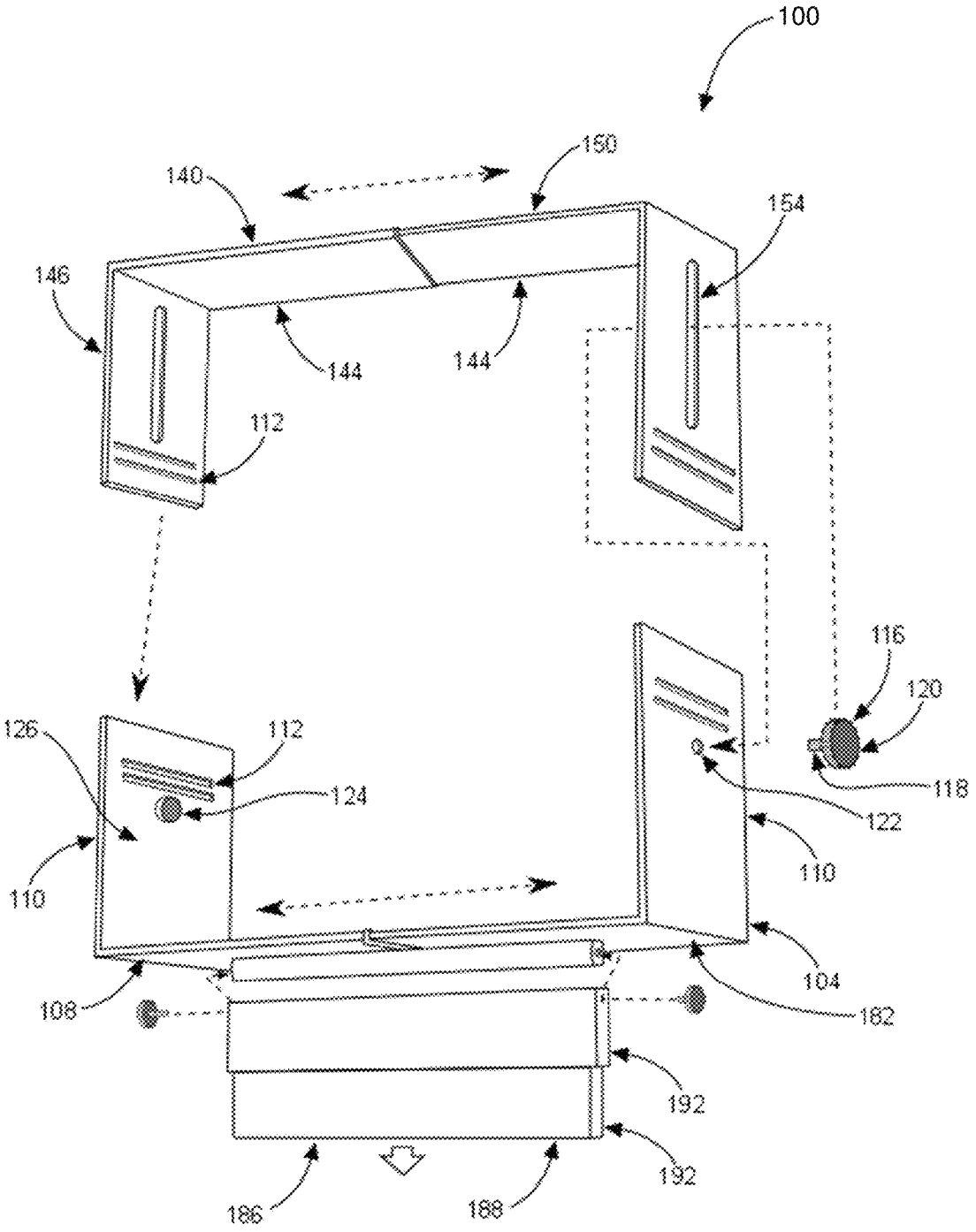
FIG. 2 is an exploded view illustrating an air conditioning mounting bracket assembly according to an embodiment of the present invention of FIG. 1.

Referring now to FIG. 2, an exploded view illustrating an air conditioning mounting bracket assembly 100 according to an embodiment of the present invention.

It further has elongated attachment bracket connection member 180 attached to bottom surface 182 of base portion 108, and includes releasable connectors on opposite ends formed as screw members 184. Support bracket member 186 including elongated panel portion 188 extends downward from main bracket member 104 base portion 108, and has releasable connector receivers 190 on opposite ends which receive screw members 184 of attachment bracket connection member 180, such that support bracket member 186 is securely attachable to main bracket member 104.

Figure 3:
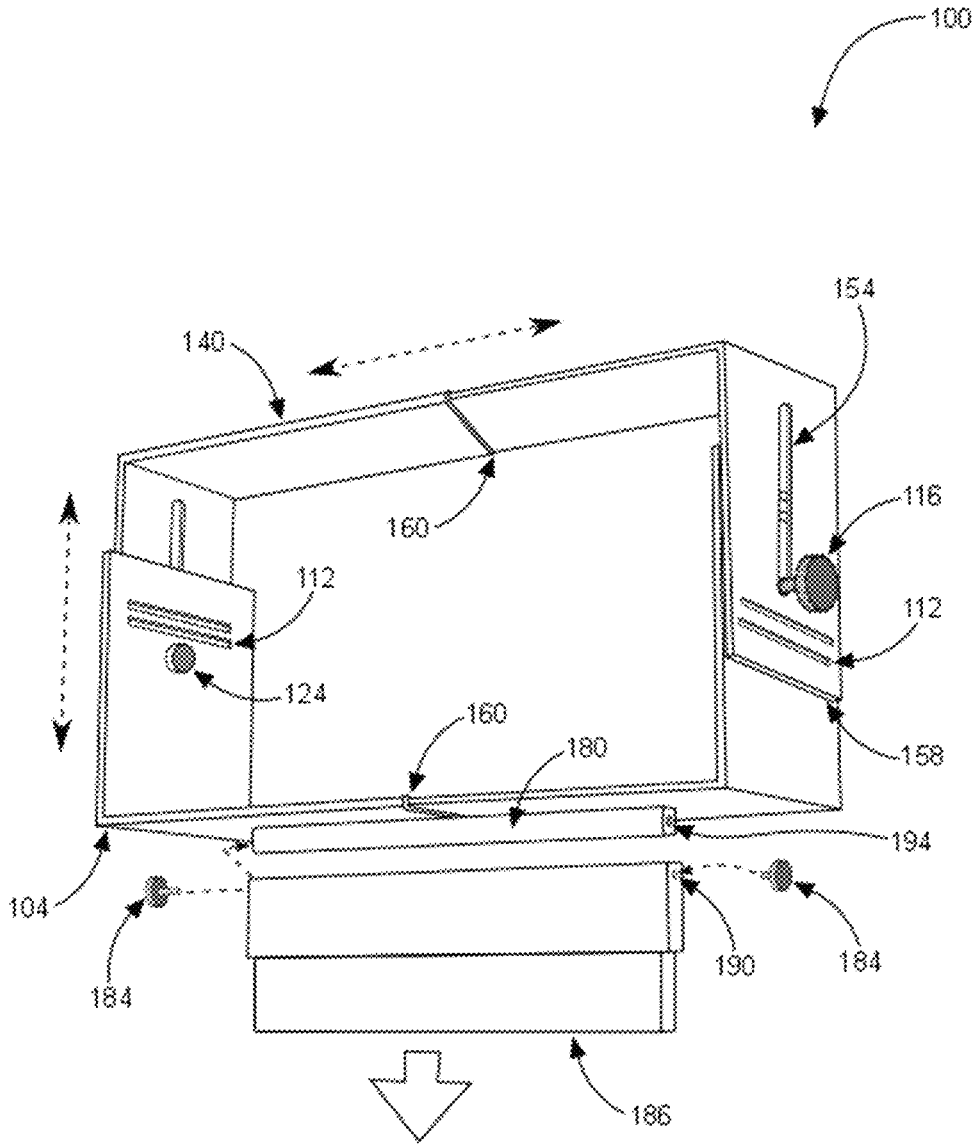
FIG. 3 is a perspective view illustrating an assembled air conditioning mounting bracket assembly with the support bracket assembly in an extended condition according to an embodiment of the present invention of FIG. 1.

Referring now to FIG. 3, a perspective view illustrating an assembled air conditioning mounting bracket assembly 100 with the support bracket member 186 in an extended condition according to an embodiment of the present invention.

Support bracket member 186 extends substantially along the length of main bracket member 104 base portion 108 and is formed as two support bracket panels 192 telescopically connected to each other, and is able to be adjusted with respect to the size of a wall or window opening. Support bracket member 186 is adapted to contact a wall or window that portable air conditioning unit 170 is to be installed within to provide support to portable air conditioning unit 170. Connector receivers 190 of elongated panel portion 188 are formed having threaded apertures 194 adapted to connect with screw members 184 of attachment bracket connection member 180.

Figure 4:
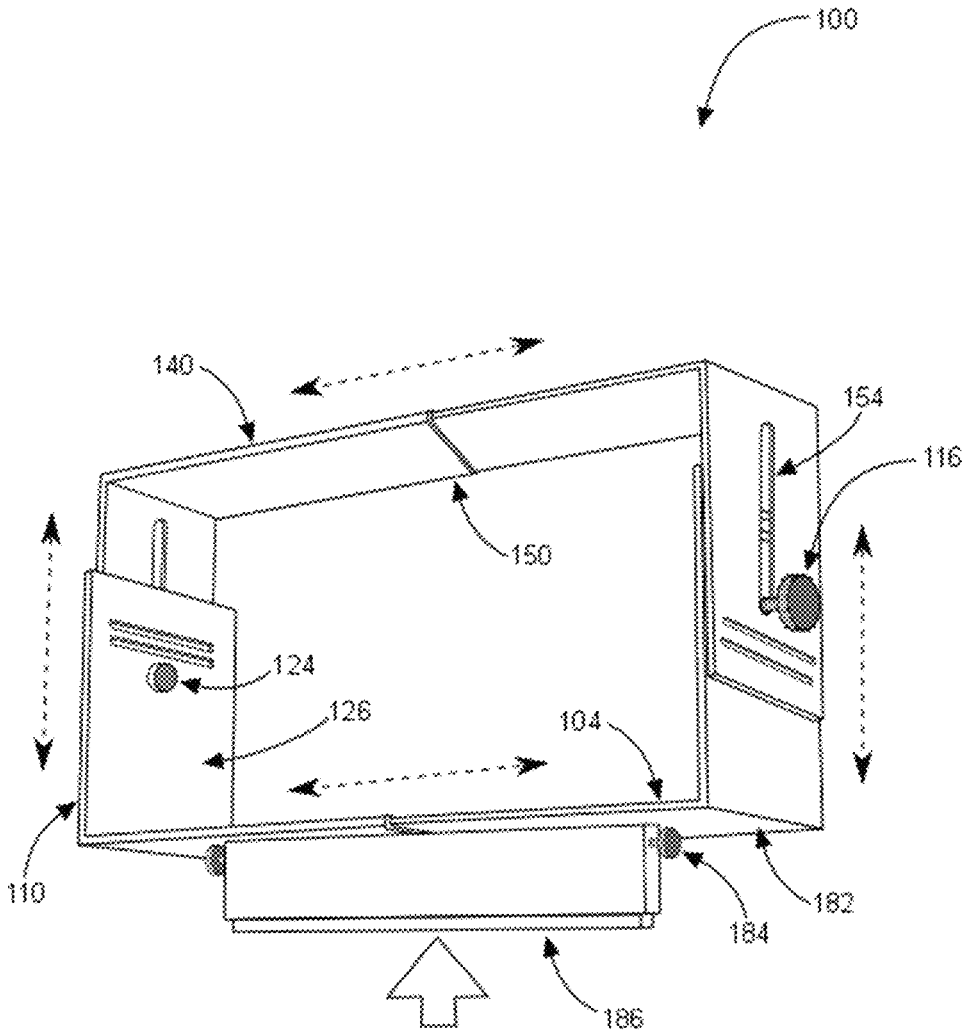
FIG. 4 is a perspective view illustrating an assembled air conditioning mounting bracket assembly with the support bracket member in a retracted condition according to an embodiment of the present invention of FIG. 1.

Referring now to FIG. 4, a perspective view illustrating an assembled air conditioning mounting bracket assembly 100 with the support bracket member 186 in a retracted condition according to an embodiment of the present invention.

Attachment member 116 of main bracket member 104 is formed having threaded post 118 and handle member 120 which threadably connects to one of the two side portions 110 having threaded aperture 122. The opposite side portion 110 of main bracket member 104 has hook and loop fastener 124 attached to inner surface 126 and is adapted to connect with hook and loop fastener 124 which is connected to side wall 172 of portable air conditioning unit 170 to aid in attaching portable air conditioning unit 170 to air conditioning mounting bracket assembly 100. Air conditioning mounting bracket assembly 100 is formed from a material chosen from a group of materials consisting of stainless steel, aluminum, plastic, and ceramic.

Air conditioning mounting bracket assembly 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, or arrangements such as, for example, including more or less components, customized parts, different color combinations, parts may be sold separately, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claim:

1. An air conditioning mounting bracket assembly for use with a portable air conditioning unit, comprising:

a main bracket member including:

a base portion;

two side portions;

wherein said two side portions are attached to opposite ends of said base portion and extend upwards therefrom;

an attachment member;

wherein said attachment member is connected to one of said two side portions and is adapted to releasably connect with a side portion of said portable air conditioning unit, to thereby removably and securely connect said air conditioning mounting bracket assembly to said portable air conditioning unit; and an attachment bracket connection member;

wherein said attachment bracket connection member is attached to a bottom surface of said base portion, is elongated, and includes a releasable connector on opposite ends thereof; and a support bracket member including;

an elongated panel portion having a releasable connector receiver on each opposite end thereof adapted to releasably receive said releasable connectors of said attachment bracket connection member therein, such that said support bracket member is releasably and securely attachable to said main bracket member; and wherein said support bracket member is adapted to contact a support portion of a wall or window that said portable air conditioning unit is to be installed within to thereby provide support to said portable air conditioning unit; and an upper bracket member formed as two brackets telescopingly connected together having side panels extending downwardly from a main portion, elongated apertures on said side panels adapted to attach to said main bracket member, such that said upper bracket member is vertically and horizontally adjustable and adapted to provide support for said main bracket member while said portable air conditioning unit is mounted therein.

2. The air conditioning mounting bracket assembly of claim 1, wherein said main bracket base portion is substantially flat and has a rectangular shape; and wherein said support bracket member extends substantially perpendicularly downward from said main bracket member base portion.

3. The air conditioning mounting bracket assembly of claim 1, wherein said two side portions of said main bracket member extend substantially perpendicularly upward from said base portion.

4. The air conditioning mounting bracket assembly of claim 3, wherein said two side portions of said main bracket each include at least one vent opening therethrough to allow air to pass therethrough.

5. The air conditioning mounting bracket assembly of claim 1, wherein said support bracket member is formed as two support bracket panels slidably and telescopically connected to one another, and is adapted to be adjusted with respect to dimensions of a wall or window opening that said portable air conditioning unit is to be installed within to thereby provide increased support to said portable air conditioning unit.

6. The air conditioning mounting bracket assembly of claim 1, wherein said releasable connectors of said attachment bracket connection member are formed as removable screw members.

7. The air conditioning mounting bracket assembly of claim 6, wherein said releasable connector receivers of said elongated panel portion are formed having threads thereon adapted to releasably connect with said screw members of said attachment bracket connection member.

8. The air conditioning mounting bracket assembly of claim 1, wherein said attachment member of said main bracket member is formed including a threaded post and a handle member; and wherein said one of said two side portions has a threaded aperture therethrough adapted to adjustably retain said attachment member therein, such that said attachment member is adapted to be adjustably turned and pressed against a side wall of said portable air conditioning unit to frictionally and releasably attach said portable air conditioning unit to said air conditioning mounting bracket assembly.

9. The air conditioning mounting bracket assembly of claim 8, wherein the other side portion of said main bracket member has a section of hook and loop fastener attached to an inner surface thereof and is adapted to releasably connect with a mating section of hook and loop fastener adapted to be connected with a side wall of said portable air conditioning unit to aid in releasably attaching said portable air conditioning unit to said air conditioning mounting bracket assembly.

10. The air conditioning mounting bracket assembly of claim 2, wherein said support bracket member extends substantially along a length of said main bracket member base portion.

11. The air conditioning mounting bracket assembly of claim 1, wherein said base portion and said two side portions of said main bracket member, said attachment bracket connection member, and said support bracket member are formed from a material chosen from group of materials consisting of stainless steel, aluminum, plastic, and ceramic.

* * * * *